United States Patent [19]

Dye

[11] Patent Number: 4,498,815

[45] Date of Patent: Feb. 12, 1985

[54] ROCK FORMATION SUPPORT PLATE

[75] Inventor: Lester L. Dye, Rinard Mills, Ohio

[73] Assignee: The Eastern Company, Naugatuck, Conn.

[21] Appl. No.: 434,673

[22] Filed: Oct. 15, 1982

Related U.S. Application Data

[63] Continuation of Ser. No. 186,825, Sep. 12, 1980, abandoned, which is a continuation of Ser. No. 19,324, Mar. 12, 1979, abandoned.

[51] Int. Cl.[3] ..... E21D 21/00

[52] U.S. Cl. ..... 405/259; 411/531

[58] Field of Search ..... 405/132, 259, 260, 261, 405/262; D8/399; 411/531, 545, 546

[56] References Cited

U.S. PATENT DOCUMENTS

| | | | |
|---|---|---|---|
| D. 236,428 | 8/1975 | Stewart et al. | D8/399 |
| 2,854,824 | 10/1958 | Curry et al. | 405/259 |
| 4,037,418 | 7/1977 | Hannan | 405/259 |
| 4,112,693 | 9/1978 | Collin et al. | 405/259 X |
| 4,189,891 | 2/1980 | Johnson et al. | 405/262 X |
| 4,249,835 | 2/1981 | White | 405/259 |
| 4,371,293 | 2/1983 | Wilcox et al. | 405/259 |

FOREIGN PATENT DOCUMENTS

| | | | |
|---|---|---|---|
| 254241 | 5/1963 | Australia | 405/259 |
| 1506674 | 4/1978 | United Kingdom | 411/531 |

*Primary Examiner*—David H. Corbin

*Attorney, Agent, or Firm*—Charles S. McGuire

[57] ABSTRACT

A load-bearing support plate for use in coal mines or other such excavations to be held in supporting engagement with the roof or walls of the excavation by an elongated bolt or rod anchored in a blind drill hole. The plate is preferably rectangular in outer periphery with a central opening for passage of the bolt or rod. It is formed from an initially flat piece of sheet steel, embossed in certain areas by a die to push portions of the metal away from the side of the plate which contacts the load-bearing qualities of the plate. The pattern includes a plurality of elongated, parallel identations in the rock-engaging surface of the plate, with the portion surrounding the central opening remaining in the plane of the original metal. Preferably, at least one on each side of the central opening; various modifications of the embossed pattern are disclosed within the general scope of the invention.

12 Claims, 3 Drawing Figures

ROCK FORMATION SUPPORT PLATE

This application is a continuation of application Ser. No. 186,825, filed Sept. 12, 1980, now abandoned, which is a continuation of application Ser. No. 019,324, filed Mar. 12, 1979, now abandoned.

BACKGROUND OF THE INVENTION

The present invention relates to bearing plates for use in the support of mine roofs, and the like.

In mine work, such as coal mining, or in underground formations such as tunnels or excavations, it is necessary to reinforce or support the roof and/or walls of the excavation to prevent rock falls or cave-ins. The most common means presently in use for effecting such support include elongated bolts or rods which are anchored in blind drill holes to hold a metal support plate in close contact with the roof or wall surface surrounding the hole. The vast majority of support plates have a central opening through which the bolt or rod passes. An integral head or threaded nut on the bolt or bar engages the plate in the area surrounding the central opening, sometimes with a hardened washer therebetween. In many installations the bolts are tensioned to several thousand pounds after being anchored at the end within the drill hole, this force being transferred to the support plate to exert a compressive force on the rock formation.

In order to provide the support and reinforcement function with the necessary degree of safety, the plates must meet certain levels of strength and rigidity, as well as being installed at appropriate intervals about the mine roof or walls. Governmental agencies have been established to set standards and supervise compliance therewith in order to insure that mine safety standards are being met. These standards require submission to and approval by the agency of a specific "roof plan" for every underground mine, setting forth the type and location of each support, as well as the individual elements used in providing the support and reinforcement. As applied to roof support plates, for example, the standards require that the plates deflect not more than a specified maximum under designated load conditions.

For reasons of both economy and ease of handling and installation, it is desirable that the support plates be as small, thin and lightweight as possible while still meeting the required standards. Economies may also be achieved by keeping the tooling and operations used in fabricating the plates as simple and inexpensive as possible. While plates of flat sheet metal, normally steel, simply cut to the proper external dimensions and punched at the center will meet the standards if thick enough, it has been found that additional structural rigidity may be imparted by embossing the plates with a suitable die. Therefore, the thickness, and accordingly the weight and cost of the material, has been reduced from that of flat plates by embossing the plate in various ways. In general, the prior art plates have been embossed in an annular pattern which encircles the central opening and/or the opening is included in the embossed area.

Embossed roof plates currently in commercial use include those generally referred to as "bell-type" and "donut-type" plates. Also, various forms of roof plates and support systems are shown and described in U.S. Pat. Nos. 3,163,012 of Dempsey, 3,161,174 of Harrison, 3,238,731 of Seifert, et al, 3,415,064 of Talobre, 3,478,523 of Reusser, et al, 3,090,203 of Durget and 4,037,418, 4,095,430 and 4,095,431, the latter three all of Hannan, and French Pat. Nos. 1,222,640 and 1,304,298.

SUMMARY OF THE INVENTION

The principal object of the present invention is to provide a mine roof support plate having structural qualities superior to those of prior plates of comparable size and thickness.

Another object is to provide a roof support plate which is embossed to increase its rigidity with relatively simple and inexpensive tooling and fabrication operations.

Other objects will in part be obvious and will in part appear hereinafter.

In accordance with the foregoing objects, the invention contemplates a support plate formed from a continuous strip of sheet steel having a width equal to that of the finished plate (e.g., 6 inches) and a thickness on the order of $\frac{1}{4}$ to $\frac{3}{8}$ of an inch. The leading end of the strip is fed into a die where a circular opening is punched, an embossing operation is performed, and a finished plate is sheared from the remainder of the strip. These operations may conveniently be performed at successive stations of a progressive die. The distinguishing features of the plate are the elongated form and pattern of the embossed areas, which provide enhanced structural rigidity while remaining simple and easy to form with relatively inexpensive tooling, the portion surrounding the central opening remaining in the plane of the metal sheet prior to embossing. No compound bends, coining (i.e., flowing of metal to increase thickness in some areas and decrease it in others), or other difficult forming operations are required.

In the preferred form, the embossed pattern includes four areas pushed from the plane of the original, flat sheet to appear as raised portions on one side of the plate and indentations on the other. The area surrounding the central opening in the plate, as well as the four marginal edges, remains in the plane of the original sheet. The embossed areas are generally elongated and parallel to one another and to two sides of the plate. Two of the areas lie between the central opening and the sides of the plate to which they are parallel. The other two embosssed areas are somewhat shorter, lying between the central opening and the perpendicular edges.

The plate is also disclosed in a number of modifications or alternative embodiments.

DETAILED DESCRIPTION

Figure 1:
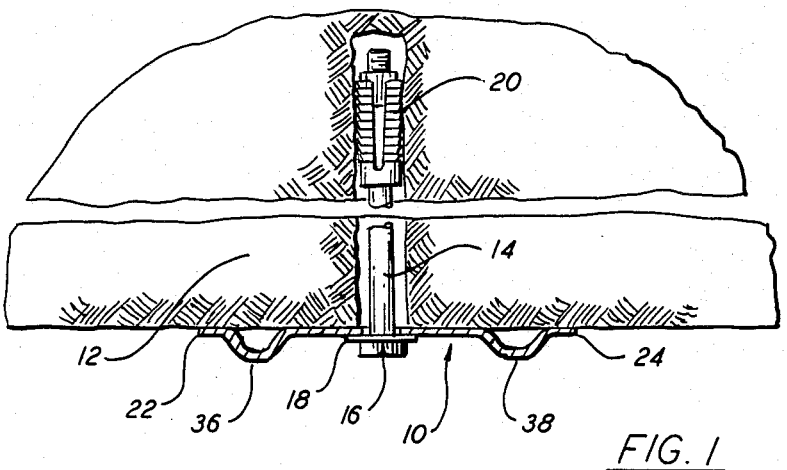
FIG. 1 is a front elevational view in vertical section showing the support plate of the invention in a preferred configuration in a typical installation with associated mine roof support elements.
Figure 2:
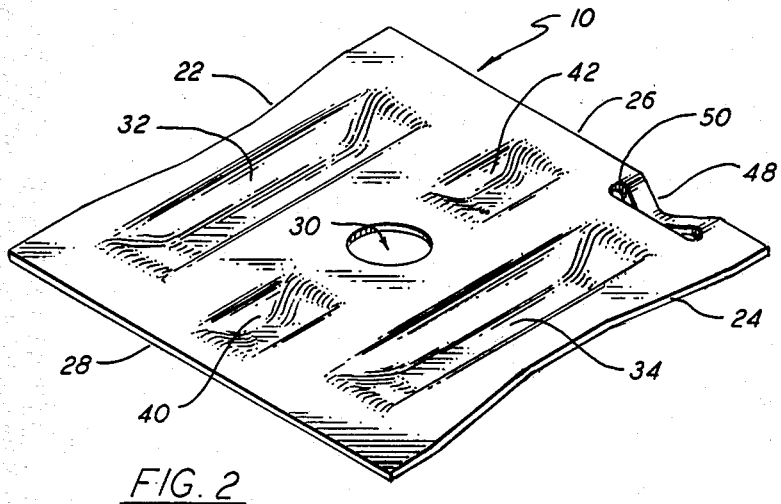
FIGS. 2 and 3 are perspective views of the support plate of FIG. 1, showing the opposite surfaces thereof.
Figure 3:
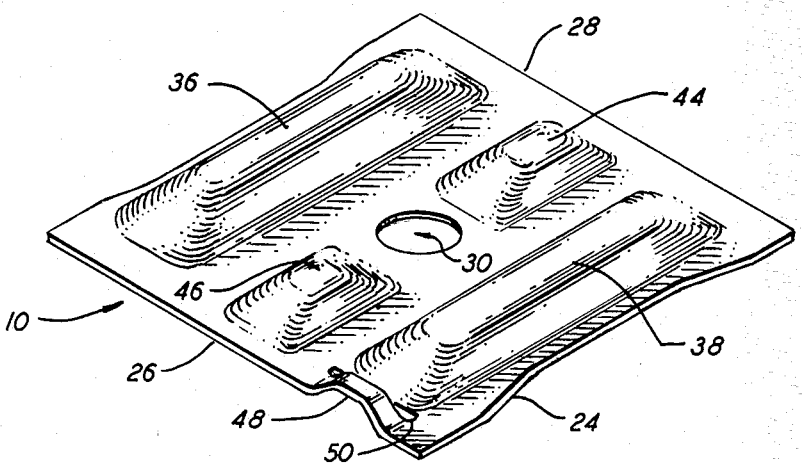

Referring now to the drawings, in FIG. 1 is shown a typical mine roof support installation including the support plate of the present invention, denoted by reference numeral 10 in the form shown in FIGS. 1–3. A blind hole is formed in rock formation 12 with conventional drilling equipment. Elongated bolt 14 extends through an opening in plate 10, which is retained thereon by bolt head 16 and washer 18, and into the drill hole. Conventional expansion anchor 20 is carried on the threaded end of bolt 14, near the blind end of the drill hole. Bolt head 16 is engaged by conventional roof bolting equipment and torque applied to pull the tapered nut into the radially expansible shell of anchor 20, thereby firmly engaging the anchor within the drill hole. As additional torque is applied, bolt 14 is tensioned to several thousand pounds, such force being transmitted through bolt head 16 and washer 18 to plate 10 and thus to the face of rock formation 12 surrounding the drill hole, serving to support the mine roof and reinforce the rock formation.

The particular means used for anchoring bolt 14 within the drill hole is of no consequence to the present invention, which is concerned with constructional details of plate 10. The installation of FIG. 1 is shown merely to provide a complete disclosure of the intended end use of the support plate of the invention. For example, bolt 14 may be anchored by conventional resin grouting, or other prior art techniques, together with or in place of the mechanical expansion anchor shown.

Turning now to FIGS. 2 and 3, it will be seen that plate 10 is rectangular in outline, having four marginal edges 22, 24, 26 and 28. The edges may be of substantially equal length, as shown, or two parallel edges may be longer than the other two. In the latter case, for plates with the embossed configuration of FIGS. 2 and 3, which will be presently described, it is preferred that edges 22 and 24 be the longer, for reasons which will become apparent. The side of plate 10 seen in FIG. 2, a planar portion of which is in contact with the face of the rock formation upon installation of the anchoring assembly, is termed the inner side or surface. The opposite side of the plate, shown in FIG. 3, is termed the outer side.

Plate 10 is integrally formed from a single piece of sheet steel preferably having a nominal thickness on the order of $\frac{1}{4}$ to $\frac{3}{8}$ inches and a high yield strength, on the order of 80,000 psi, for example. The plates may conveniently be formed by conventional sheet metal working techniques in a continuous sequence by feeding an elongated strip of steel of proper width and thickness through a multi-station die, although other fabrication techniques are also available. The die includes a punch which forms an opening midway between the edges of the strip and at a distance from the leading end equal to half of the length of the finished plate. Thus, opening 30 is centrally located with respect to the edges of plate 10 upon shearing thereof from the remainder of the continuous strip.

The embossed pattern is formed by striking the plate with suitably formed dies to provide a plurality of discrete indentations on the inner side and raised portions on the outer side of plate 10, as seen in FIGS. 2 and 3, respectively. It will be noted that all of the embossed areas are generally elongated upon axes parallel to one another and to two edges, 22 and 24, of plate 10. Indentations 32 and 34, and corresponding raised portions 36 and 38, lie on axes on opposite sides of opening 30 and extend for a major portion of the length of plate 10. Considerably shorter indentations 40 and 42, and corresponding raised portions 44 and 46, lie upon a common axis intersecting the center of opening 30.

It will be noted that all portions of the indentations, and consequently of the raided portions, lie inwardly of the marginal edges of plate 10. Thus, each indentation and raised portion is completely surrounded by planar portions which remain in the plane of the metal sheet prior to the embossing operation. Likewise, opening 30 is completely surrounded by a planar portion which in the preferred embodiment is contiguous as well as coplanar with the portions surrounding the indentations and raided portions.

Plate 10 further includes an integrally formed hanger-receiving member 48. It has become conventional to attach, or othewise associate with mine roof plates, hanger-receiving means from which cables, telephone and electric wires, and other mine equipment may conveniently be suspended. Member 48 provides such means in combination with plate 10 of the present invention, being formed by punching elongated slot 50 parallel and adjacent to edge 28 and embossing the strip thus formed between slot 34 and edge 28 (and in fact including a portion of edge 28) to form a loop-like member extending in the same direction from the general plane of the plate as raised portions 36, 38, 44 and 46. It will be further noted that member 48 lies on the axis of indentation 34 and raised portion 38, being conveniently formed in the same embossing operation. If desired, more than one hanger-receiving member such as 50 may be provided, each being preferably formed in the same manner along an edge portion of the plate and integral therewith.

While the precise dimensions of the indentations and corresponding raised areas are not considered critical, it is desired that the plate present a relatively low profile on its outer side. For example, the raised portions may extend from the plane of the outer surface for a distance approximately twice the thickness of the metal sheet from which the plate is formed. In this manner the bolt head is slightly inside a line extending between the crests of raised portions 36 and 38, as may be seen in FIG. 1, whereby the embossed portions protect the bolt head from being sheared off or otherwise damaged from being struck by mine equipment and machinery. At the same time, the plate has a very low profile relative to other designs in current use such as bell or donut-type plates.

It is readily apparent that numerous variations in the disclosed design are possible within the general scope of the invention. For example, although there must be a plurality of elongated, individual embossed areas, separated by planar portions which remain in the plane of the original sheet and surround the central opening, each embossed portion need not lie along a straight axis for its entire length. Also, the axes of all embossed portions need not be parallel. Rather than lying completely within the marginal edges of the plate, the embossed areas may extend the full length of the plate; however, if the plates are sheared from the remainder of a continuous strip of metal sheet transversely to the axes of the embossed portions, a more complicated shearing die will be required.

While it is preferred that the configuration of the enclosed portions be substantially as illustrated in the accompanying drawing, variations in this design are also possible. For example, rather than being essentially square at each end (in plan view) the ribs may have rounded, pointed, fluted or angled ends. Likewise, the ribs may be of various shapes in transverse cross section, although it is preferred that the shape be substantially constant along the length of the ribs. Such cross sectional shapes could include square, sloped, peaked, dimpled, sloped with flat crown, etc.

Bearing plates constructed in accordance with the invention, configured as shown in the accompanying drawing, were tested according to the procedures outlined in ASTM F 432-77 and found to possess exceptional mechanical properties. For example, the plates of the present invention, as compared to conventional donut-style plates constructed from the same material and subjected to the same test, showed 59% less deflection at 15,000 pounds load, 65% less deflection at 20,000 pounds load and 42% higher yield strength. Moreover, plates can be constructed in accordance with the present invention from higher grade steels and thinner stock than the donut-style plates due to cracking, unacceptable deflection and yield strength, etc., encountered in donut-style plates constructed from such materials. It has also been found that variations in the center hole diameter (e.g., between 13/16" and 1⅜"), and die location relative to "direction of rolling" of the metal stock have no significant effect on test results or formability.

What is claimed is:

1. A bearing plate having a first surface for supporting engagement with the surface of a rock formation surrounding a drill hole in which one end of an elongated rod is securely anchored, the other end extending outside the drill hole and having engagement means for supporting contact with a second surface of the plate, said plate comprising a unitary sheet of high-strength metal having:

(a) first and second major surfaces on opposite sides thereof:

(b) a plurality of elongated, parallel, mutually distinct and separated areas embossed in said plate to extend inwardly into said first major surface and outwardly from said second major surface, said first and second major surfaces forming substantially the entire surface areas of said plate other than in said embossed areas;

(c) a peripheral border;

(d) a substantially centrally disposed opening for loose passage of said rod;

(e) said embossed areas all being spaced inwardly from said border and spaced from said opening by a distance sufficient to accommodate said engagement means between said embossed areas, at least one pair of said areas lying on opposite sides of said opening; and (f) substantially all of said first and second major surfaces lying respectively in first and second parallel flat planes, and entirely surrounding said embossed areas, said opening and said border, whereby substantially all of said first major surface may be placed in supporting engagement with said rock formation surface, with said engagement means in supporting contact with said second major surface entirely inwardly of said embossed areas.

2. The invention according to claim 1 wherein said engagement means comprises a washer and means carried on said other end of said rod for maintaining said washer in supporting engagement with said second major surface in the area surrounding said opening.

3. The invention according to claim 2 wherein said means carried on said other end of said rod comprise an integral head adapted to be engaged by a wrench for imparting rotation to said rod.

4. The invention according to claim 1 wherein said peripheral border is substantially rectangular and all of said embossed areas lie along axes parallel to one another and to two of the sides of said border.

5. The invention according to claim 1 wherein said one pair of said areas lie on opposite sides of a line extending diametrically across said opening and parallel to said one pair of said areas.

6. The invention according to claim 5 wherein said one pair of said areas are equally spaced from said line.

7. The invention according to claim 6 wherein said one pair of said areas are equal in length to one another and extend for a majority of the length of said plate.

8. A support system for a rock formation having a drill hole extending into the formation from a surface thereof, said system comprising, in combination:

(a) an elongated rod having first and second ends;

(b) anchor means firmly holding said first rod end within the drill hole with said second rod end outside the drill hole;

(c) a support plate formed of a unitary sheet of high-strength metal having a peripheral border, first and second major surfaces on opposite sides and a substantially central opening of diameter larger than said rod;

(d) a plurality of elongated, parallel, mutually distinct and separated areas embossed in said plate to extend inwardly into said first major surface and outwardly from said second major surface, said first and second major surfaces forming substantially the entire surface areas of said plate other than in said embossed areas;

(e) said embossed areas all being spaced inwardly from said border and spaced from said opening, by a distance sufficient to accommodate said engagement means between said embossed areas, at least one pair of said areas lying on opposite sides of said opening; and (f) substantially all of said first and second major surfaces lying respectively in first and second parallel flat planes, and entirely surrounding said embossed areas, said opening and said border, whereby substantially all of said first major surface may be placed in supporting engagement with said rock formation surface, with said engagement means in supporting contact with said second major surface entirely inwardly of said embossed areas.

9. The invention according to claim 8 wherein said engagement means comprises a washer carried by said rod and means for maintaining said washer in supporting contact with the portion of said second major surface surrounding said central opening between said one pair of said areas.

10. The invention according to claim 9 wherein said means for maintaining said washer in supporting contact comprise an integral head on said second rod end.

11. The invention according to claim 8 wherein said border is substantially rectangular and all of said embossed areas lie along axes parallel to one another and to two of the edges of said border, and said axes of said one pair of embossed areas are equally spaced from said opening.

12. The invention according to claim 8 wherein said plate further includes a second pair of said areas lying along a common axis intersecting said opening, said engagement means being positioned inwardly of all of said first and second pairs of said areas.

* * * * *